US006135742A

United States Patent [19]

Cho

[11] Patent Number: 6,135,742

[45] Date of Patent: Oct. 24, 2000

[54] ECCENTRIC-TYPE VANE PUMP

[76] Inventor: Bong-Hyun Cho, 271-1 Shinheung-Ri, Bookil-Myun, Jansung-Koon, Chollanam-Do, Rep. of Korea

[21] Appl. No.: 09/141,791

[22] Filed: Aug. 28, 1998

[51] Int. Cl.[7] ..... F04C 18/00

[52] U.S. Cl. ..... 418/173; 418/177; 418/102; 417/295; 417/283; 192/12 A

[58] Field of Search ..... 418/173, 177, 418/102; 417/295, 283; 192/12 A

[56] References Cited

U.S. PATENT DOCUMENTS

| | | | |
|---|---|---|---|
| 3,667,580 | 6/1972 | Schacher et al. | 192/12 A |
| 3,865,515 | 2/1975 | Allen | 417/283 |
| 4,594,062 | 6/1986 | Sakamaki et al. | 418/173 |
| 4,595,347 | 6/1986 | Sakamaki et al. | 418/173 |
| 4,620,837 | 11/1986 | Sakamaki et al. | 418/173 |
| 4,648,819 | 3/1987 | Sakamaki et al. | 418/173 |
| 4,867,651 | 9/1989 | Nakajima et al. | 417/295 |
| 4,976,592 | 12/1990 | Nakajima et al. | 417/295 |
| 5,049,041 | 9/1991 | Nakajima | 417/295 |

*Primary Examiner*—Thomas Denion
*Assistant Examiner*—Thai-Ba Trieu
*Attorney, Agent, or Firm*—Senniger, Powers, Leavitt & Roedel

[57] ABSTRACT

The present invention relates to an eccentric-type vane pump and, in particular, to an eccentric-type vane pump being capable of generating minimum heat and noise due to frictional force produced from rotation of the vane pump. The vane pump comprises a rotor connected to a rotor shaft having vanes slidably received in vane grooves and recessed within a space in the periphery of the rotor for moving radially by rotation of the rotor. A cylinder ring is positioned eccentrically around the rotor and is rotated by the frictional force produced from abutting the front end of the vanes. A pump chamber is formed between the rotor and the cylinder ring. A cylinder body is provided having a bearing between the outer surface of the cylinder ring and the cylinder body. A front body is connected to a first end of the cylinder body. One end of a rotor shaft is supported on a recess formed on one side of the front body. A rear body is connected to a second end of the cylinder body, the rotor shaft being extended through the rear body to rotate. The rear body has a vane oil distribution channel which supplies oil pressure exerting on the vanes and a cylinder oil distribution channel which supplies oil pressure exerting on the cylinder ring from a bearing therein.

3 Claims, 4 Drawing Sheets

MERCATOR PROJECTION OF THE OILLESS BEARING
(for a hydraulic pump)

MERCATOR PROJECTION OF THE OILLESS BEARING
(for an air compressor)

ECCENTRIC-TYPE VANE PUMP

FIELD OF THE INVENTION

The present invention relates to an eccentric-type vane pump and, in particular, to an eccentric-type vane pump being capable of generating minimum heat, noise, and wear caused by frictional force during operation.

BACKGROUND OF THE INVENTION

Prior to the present invention, a conventional vane pump primarily used in machine tools and industrial machines includes, as shown in FIG. 1, in a cylinder body (2) a rotor having a number of vane grooves (10) formed on a peripheral surface thereof and driven by a rotor shaft (5). Vanes (12) are slidably received in the vane grooves (10) for radial reciprocating motion, and a hollow cylinder (6) is formed in the peripheral direction of the rotor (4) and abuts the front-end section of the vanes (12) fitted in the vane grooves (10) of the rotor (4).

A crescent-shaped pump chamber (8) is formed between the rotor (4) and the hollow cylinder (6) because the rotor (4) is eccentrically installed relative to the hollow cylinder (6). The volume of the crescent-shaped pump chamber (8) varies with the rotation of the rotor (4) due to the eccentricity.

When the rotor (4) is rotated by the rotor shaft (5), vanes (12) slidably received in the vane grooves (10) protrude from the center of the rotor (4) toward the hollow cylinder (6) due to centrifugal force so that the vanes (12) are in abutment with the inner surface of the hollow cylinder while the rotor (4) rotates.

Vane pumps operating in the above mentioned manner intake fluid to be compressed at an intake section (13) in which the volume of the crescent-shaped pump chamber (8) increases gradually and exhaust it at an exhaust section (14) in which the volume decreases gradually.

In the structure of such a vane pump, oil which flows from the exhaust chamber of a rear body (not shown) through an oil distribution channel of a vane back pressure chamber to the lower part of the vane grooves (10) in the rotor increases an abutting force between the front end section of vane (12) and the inner surface of the hollow cylinder so that a backward flow of fluid to be compressed is prevented.

But the structure of the prior art vane pump presents a problem in that, at high speed rotation, as the pressure of the fluid to be compressed increases, the adherent frictional force between the front end section of the vane (12) and the inner surface of the hollow cylinder (6) increases, which causes rapid and severe wear and burning between the vanes (12) and the inner surface of the hollow cylinder (6). The life-cycle of the vane pump is thus reduced.

OBJECT OF THE INVENTION

An object of the present invention is to solve the above mentioned problems inherent in the prior art vane pumps, and to provide an eccentric vane pump capable of running smoothly under high pressure and high speed, which reduces considerably heat and wear between the vanes and the inner surface of the hollow cylinder. Said eccentric vane pump is constructed in such a way that the hollow cylinder which is in abutment with the vanes received in the rotor rotates concurrently with the rotor.

SUMMARY OF THE INVENTION

Briefly, apparatus of this invention is an eccentric-type vane pump (hereinafter referred to as "vane pump"), which comprises a rotor connected to a rotor shaft; vanes which move in radial motion by rotation of the rotor and are slidably received in vane grooves which are recessed within a space along the peripheral direction of the rotor. A cylinder ring is mounted eccentrically around the rotor and is rotatable by frictional force produced by an abutting front end of the plurality of vanes. A pump chamber is formed between the rotor and the cylinder ring. A cylinder body has a bearing between an outer surface of the cylinder ring and the cylinder body. A front body is connected to a first end of the cylinder body and the one end of the rotor shaft is supported on a recess formed on one side of the front body. A rear body is connected to a second end of the cylinder body and the rotor shaft extends through the rear body. The rear body has a vane oil distribution channel which supplies oil exerting on the vanes and a cylinder oil distribution channel which supplies oil exerting on the cylinder ring from the bearing therein.

Additional features and advantages of the present invention will be better understood by reference to the following detailed description taken as a non-limitating example and illustrated in the drawings.

DETAILED DESCRIPTION OF THE INVENTION

Figure 1:
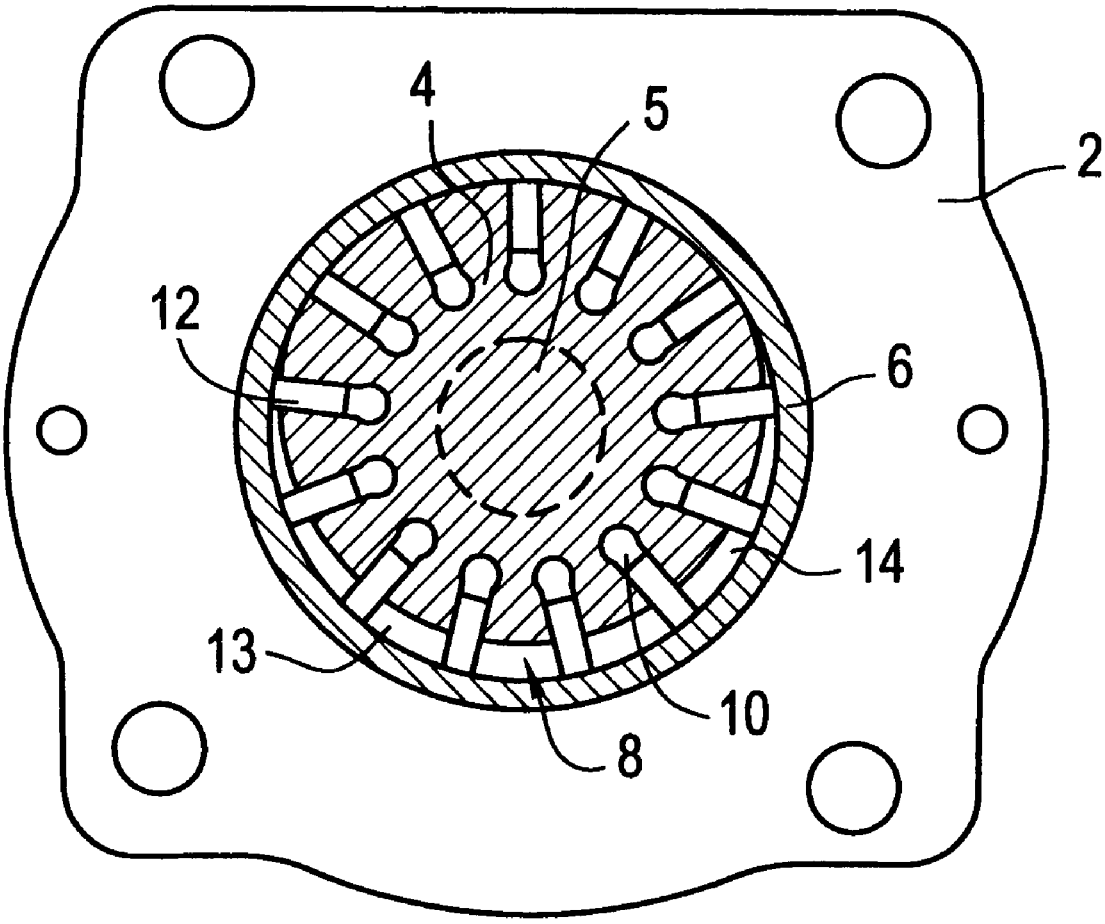
FIG. 1 PRIOR ART
FIG. 1 is a cross-sectional view illustrating a conventional vane pump.
Figure 2A:
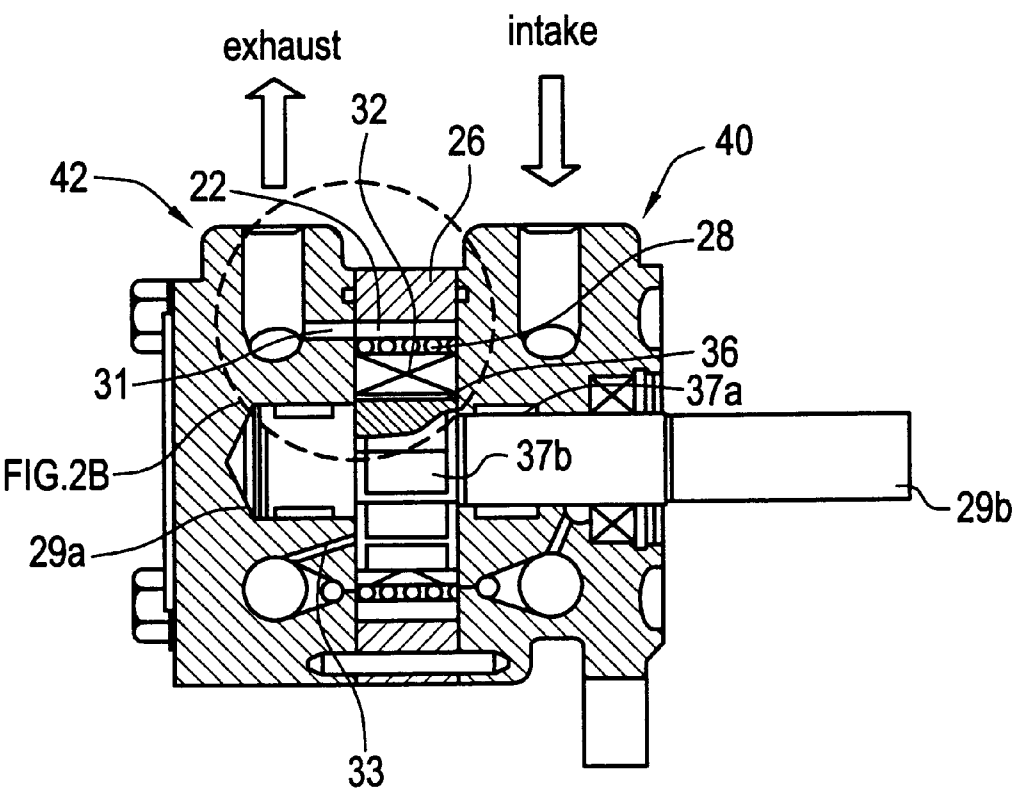
FIG. 2A is a cross-sectional view illustrating a vane pump in accordance with the present invention.
Figure 2B:
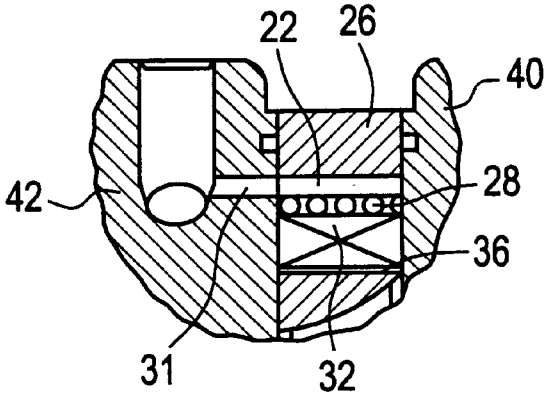
FIG. 2B is an enlarged view of a portion of FIG. 2A.
Figure 3:
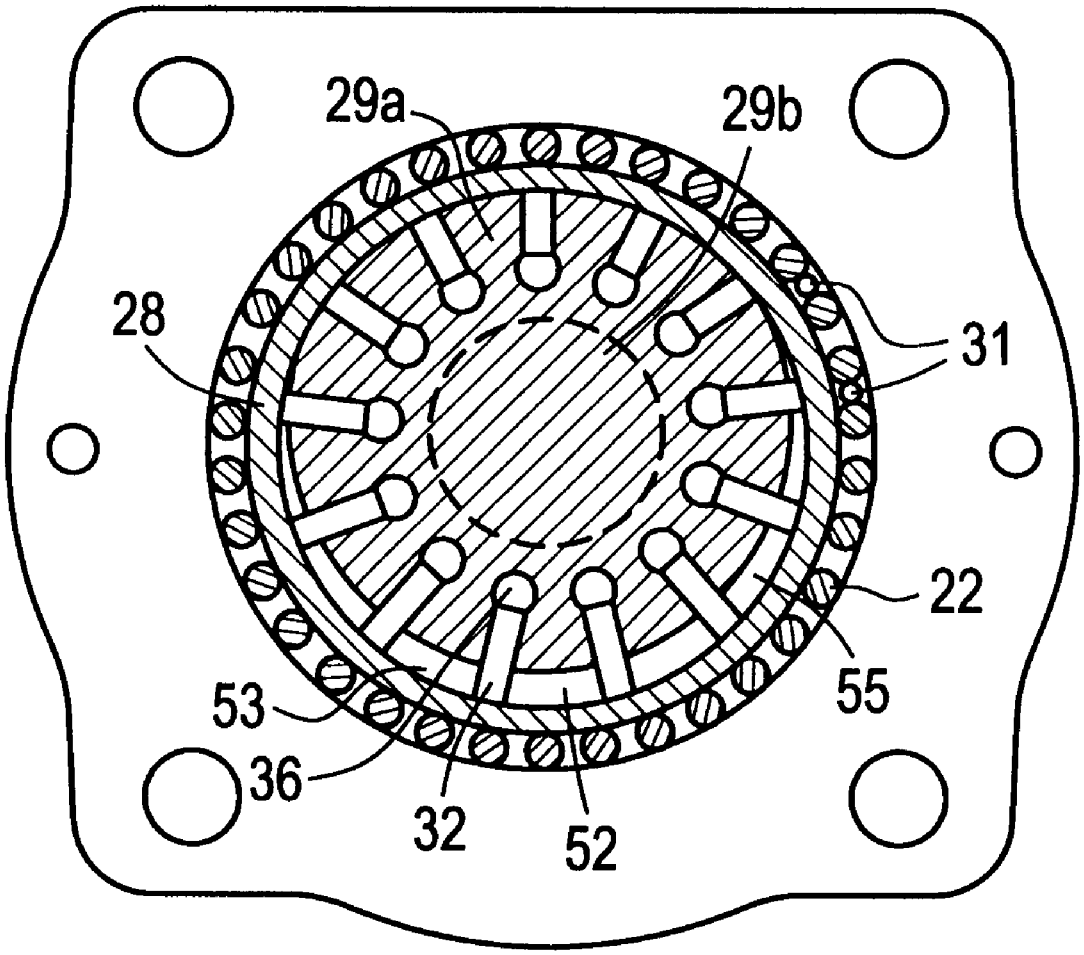
FIG. 3 is a cross-sectional view similar to FIG. 1, illustrating a vane pump in accordance with the present invention.
Figure 4A:
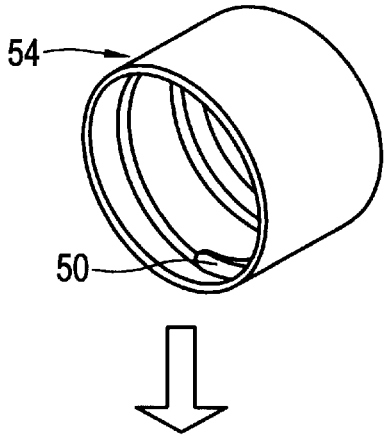
FIG. 4(A) is a perspective view of the oilless bearing.
Figure 4B:
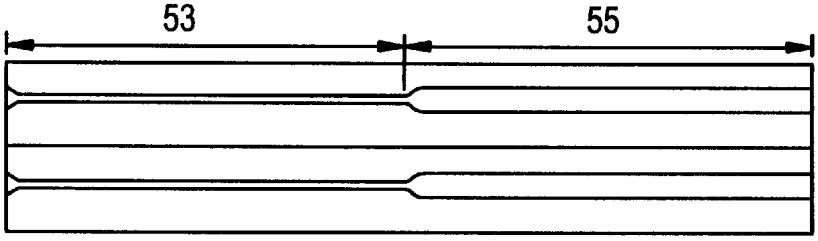
FIGS. 4(B) and 4(C) are Mercator projections of embodiments of the back pressure groove formed on the inner wall of the oilless bearing.
Figure 4C:
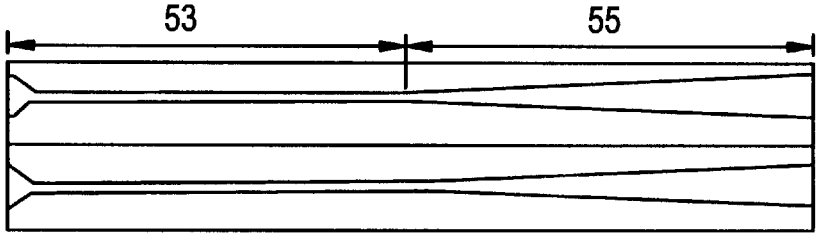

FIG. 2 shows a vane pump in accordance with the present invention and FIG. 3 shows a sectional view of the rotor in accordance with the present invention. FIG. 4(A) is a perspective view of the oilless bearing and FIGS. 4(B) and 4(C) are Mercator projections of the back pressure groove formed on the inner wall of the oilless bearing.

As illustrated in FIG. 2, the vane pump of the present invention comprises a rotor **(29*a*), and a rotor shaft (29*b*). Vanes (32) are fitted in vane grooves (36) of rotor (29*a*) integrally connected to the rotor shaft (29*b*) sliding along the vane grooves (36). The vanes (32) move in a radial direction of the rotor (29*a*) and protrude when the rotor (29*a*) is rotated due to centrifugal force. A front-end section of the vanes (32) abuts the inner surface of a cylinder ring (28)**.

A needle bearing (22) is provided between the cylinder ring (28) and a cylinder body (26) so that the front-end section of the vanes (32) are in abutment with the inner surface of the cylinder ring (28) and may rotate concurrently with the cylinder ring (28) to reduce the frictional force of the inner, the outer, and the side surface of the cylinder ring (28).

As shown in FIG. 3, due to the interaction between the vanes (32) and the cylinder ring (28), fluid to be compressed moves through a pump chamber (52) formed between the rotor **(29*a*) and the cylinder ring (28). The pump chamber (52) has an intake section (53) and an exhaust section (55)**.

The vane pump as shown in FIG. 2 is provided with a front body (40) at the one end of the cylinder body (26) and a rear body (42) at the other end of the cylinder body. One end of the rotor shaft **(29*b*) is supported on a recess formed on one side of the front body (40), which is connected to one end of the cylinder body through a front bushing (37*a*) so that smooth rotational movement can be ensured. Further, the rotor shaft (29*b*) is connected through the rear body (42) connected through a back bushing to the other side of cylinder body (40)** to ensure smooth rotational movement of the rotor shaft.

In the front body (40) of the vane pump, a first oil distribution channel (33) connected between a back pressure chamber and the vane grooves (36) is formed so as to push the vanes (32) toward the inner surface of the cylinder ring (28). A second oil distribution channel (31) is formed between the back pressure chamber and the outer peripheral region of the cylinder ring (26) where the needle bearings (22) are installed to provide to the outer surface of the cylinder ring (26) the same pressure as the pressure provided to the vane grooves (36).

Referring to FIG. 3, the pressure of oil supplied through the second oil distribution channel (31) to the outer peripheral region of the cylinder ring (28) is the same pressure as that provided to the vane grooves so that force produced from the frictional force of the vane (32) from the intake section (53) and the exhaust section (55) of the pump chamber (52) is distributed evenly.

Thus, according to the present invention, when the rotor shaft **(29*b*) borne on the recess formed in the middle of the front body (40) is rotated by a driving motor (not shown), the vanes (32) move radially along the vane grooves (36) by centrifugal force created by rotation of the rotor (29*a*). The vanes thereby protrude and abut the inner surface of the cylinder ring (20). The pumping of the vane pump is thus performed. The higher the speed of the rotor (29*a*), the larger the abutting force (caused by the pressure of oil introduced from the back pressure chamber through the second oil distribution channel (31)) between the front end of the vane (32)** and the inner surface of the cylinder ring.

The pressure of oil introduced from the back pressure chamber through the second oil distribution channel (31) into the needle bearing (22) on the outside of the cylinder ring (28) exerts force on the outside of the cylinder ring (28) which keeps the pressure on the inner and outer surfaces of the cylinder ring (28) the same. This protects the cylinder ring (28) from being deformed under the pressure of oil introduced into the vane groove (36), minimizes the friction force against the needle bearing (22), and makes it possible to run the vane pump under high pressure and high speed.

Further, an oilless bearing (54) may be used instead of the needle bearing, as shown in FIG. 4. In such an embodiment, a back pressure groove (50) is formed on the inner surface of the cylindrical oilless bearing (54) to reduce the frictional force generated on the outer peripheral surface of the cylinder ring (28). The back pressure groove (50) is formed so that an area proportional to the pressure reaction by fluid flowing at the intake section (53) and the exhaust section (55) of the pump chamber (52) is formed between the inner peripheral surface of the cylinder ring (28) and the outer peripheral surface of the rotor **(29*a*). The back pressure groove (50) can also be used for a hydraulic oil pump and compressor since it reduces the frictional force exerted on the outer peripheral surface of the cylinder ring (28) and the contact surface of the oilless bearing (54)**.

FIGS. 4(B) and 4(C) show embodiments of the cylindrical oilless bearing (54) spread out in a plane. The pump chamber (52) is divided into two parts, the intake section (53) and the exhaust section (55), to effectively reduce the friction force exerted on the oilless bearing. The pressure falls evenly on the cylinder ring (28) because the back pressure groove (50) is formed on the inner surface of the oilless bearing (54) in the direction of the periphery in such a way that the area of the exhaust section (55) is broader than that of the intake section (53). The oilless bearing (54) can be used for a hydraulic oil pump and compressor because the area of the exhaust section (55), beginning at the end of intake section (53), is increased gradually in the direction of the periphery to the end of the exhaust section (55).

While preferred embodiments of the present invention have been described and shown, it will be apparent to those skilled in the art that various changes and modification may be made without departing from the spirit and scope of the present invention.

As mentioned before, the vane pump in accordance with the present invention ensures that the pressure of the oil is exerted evenly on the inner surface and the outer surface of the cylinder ring, thus, the cylinder ring is protected from being deformed by pressure, and heat and noise caused by the frictional force created by the abutment of the cylinder ring and the vanes received in the vane grooves of the rotor can be reduced. The vane pump of the present invention thus has a wider utility as compared to prior art vane pumps, which are primarily used under low pressure and mid speed. The vane pump of the present invention can be used under high pressure and high speed and the life-cycle of the vane pump is also prolonged as compared to the prior art vane pump.

What is claimed is:

1. An eccentric-type vane pump comprising:

a rotor connected to a rotor shaft, said rotor having a plurality of vanes which can move radially by rotation of the rotor, each of said plurality of vanes being embedded in one of a plurality of vane grooves which are recessed within a space in a peripheral direction of the rotor;

a cylinder ring mounted eccentrically around the rotor and rotatable by frictional force produced by an abutting front end of the plurality of vanes;

a pump chamber formed between the rotor and the cylinder ring;

a cylinder body having a bearing between an outer surface of the cylinder ring and the cylinder body, the bearing being an oilless bearing having a back pressure groove formed therein;

a front body connected to a first end of the cylinder body, the one end of the rotor shaft being supported on a recess formed on one side of the front body; and a rear body connected to a second end of the cylinder body, the rotor shaft extending through the rear body, said rear body having a vane oil distribution channel which supplies oil pressure exerting on the vanes and a cylinder oil distribution channel which supplies oil pressure exerting on the cylinder ring from a bearing therein.

2. An eccentric-type vane pump according to claim 1, wherein the back pressure groove is formed on the inner peripheral surface of the oilless bearing in the peripheral direction, and the area of an exhaust section formed in a first half of the back pressure groove is wider than that of the intake section formed in a second half of the back pressure groove.

3. An eccentric-type vane pump according to claim 2, wherein the width of the back pressure groove becomes wider as it goes from a starting point of the intake section to the end of the exhaust section.

* * * * *